US005112061A

United States Patent [19]

Lamle

[11] Patent Number: 5,112,061

[45] Date of Patent: May 12, 1992

[54] COURT GAME SET AND PROJECTILE THEREFOR

[76] Inventor: Stuart Lamle, 3 Fordham Hill Oval, Suite 15F, Bronx, N.Y. 10468

[21] Appl. No.: 704,445

[22] Filed: May 23, 1991

[51] Int. Cl.[5] ..... A63B 61/00; A63B 65/00; A63B 71/02

[52] U.S. Cl. ..... 273/411; 273/298; 273/428

[58] Field of Search ..... 273/411, 428, 415, 417, 273/29 B, 29 R

[56] References Cited

U.S. PATENT DOCUMENTS

| | | | |
|---|---|---|---|
| 2,484,475 | 10/1949 | Studer | 273/417 |
| 3,368,815 | 2/1968 | Alabastro | 273/417 |
| 3,393,911 | 7/1968 | Lawson | 273/428 |
| 3,480,280 | 5/1967 | Gamertsfelder | 273/415 |
| 3,924,856 | 12/1975 | Dekan et al. | 273/415 |
| 3,980,299 | 9/1976 | Brown | 273/29 R |
| 4,088,319 | 5/1978 | Clarke | 273/428 X |
| 4,294,447 | 10/1981 | Clark | 273/428 X |
| 4,826,179 | 5/1989 | Callaghan | 273/428 |
| 4,943,066 | 7/1990 | Lathim et al. | 273/428 |

*Primary Examiner*—William H. Grieb
*Attorney, Agent, or Firm*—Robert W. J. Usher

[57] ABSTRACT

A court game set including an outer court and an inner court located centrally within the outer court and bisected medially by a net which spans overarm throwing height extending between standing and jumping players. The game rules require that a point is scored if a projectile, launched over the net, hits the ground on the other side of the net anywhere within the outer court, having avoided capture by an opponent or, of launched under the portion of the net aligned over the inner court, hits the ground of only the inner court. The projectile is a deformable mass located at a blind end of a flexible tube that can be swung for manual launching at great speed but which will deform on contact, absorbing impact.

21 Claims, 3 Drawing Sheets

Fig. 2(a)
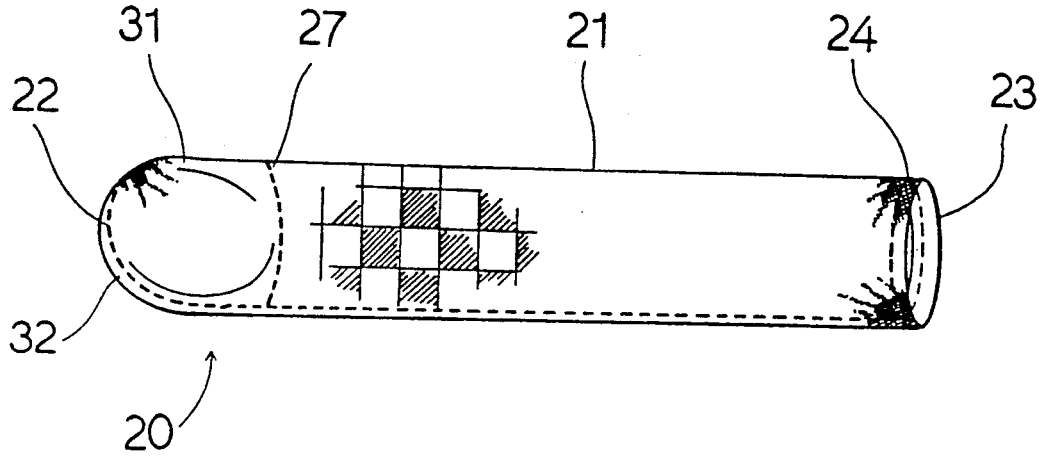
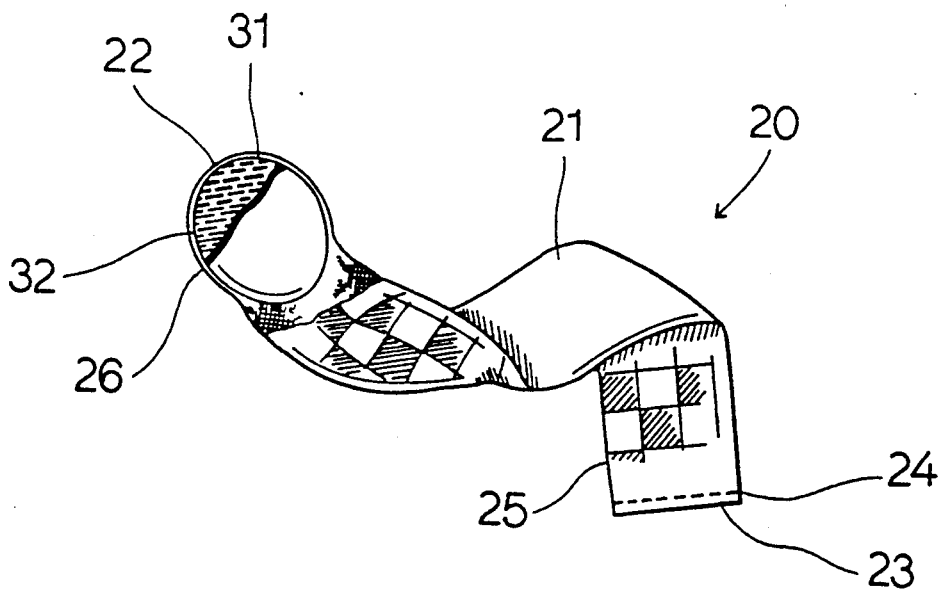
Fig. 2(b)

COURT GAME SET AND PROJECTILE THEREFOR

FIELD OF THE INVENTION

The invention relates to a court game and to a projectile used in the game.

BACKGROUND OF THE INVENTION

In spite of the many court games known and played over the years, a need exists for a court game providing new aspects of amusement for players of both very high and very low levels of skill and mobility and which can be played with relatively very little equipment and capital outlay. Furthermore, any such game should appeal to all ages and family groups for spontaneous play in public places, requiring a projectile constructed to minimize risk of pain or injury either to the players, spectators or bystanders hit inadvertently, particularly very young children, thus enabling the game to be played, for example on public beaches.

At the same time the projectile should be both durable and of low manufacturing cost, adapted for manufacture for the mass market place by conventional mass production techniques.

Furthermore, such projectile should be both attractive to but harmless to young children, in particular, devoid of hard, sharp, breakable or toxic objects and sized to obviate risk of ingestion and choking so that the projectile can be freely carried and used by young children without supervision.

Many prior attempts at providing amusing projectiles have been documented. For example U.S. Pat. No. 4,294,447 to Clarke teaches the attachment of streamers to a resilient ball. However, hard objects are required to effect the attachment, while incremental breakage of streamers may occur during twirling with consequential risk of dislodgement of the hard body. Furthermore, the commercially available sponge rubber ball taught as suitable has insufficient density to permit a very high speed to be maintained in flight particularly with the presence of drogue- forming streamers.

Other documents teaching projectiles including streamers, trailing flights or drogues, include U.S. Pat. No. 2,484,475 to Studer, disclosing a shuttlecock, but with a stiff or hard leading end; U.S. Pat. No. 3,368,815 teaching a streamer-tailed projectile; but with a metal cap; U.S. Pat. No. 4,088,319 a ribbon-tailed plastic ball, but with a hard mobile weight therein.

Other patents document projectiles which include ball-like skins filled with particulate material which is, however, not sufficiently effective in force distribution on impact, such as described in U.S. Pat. No. 4,943,066 and U.S. Pat. No. 3,480,280, while the only partial filling, together with the presence of interstices between particles, preclude the projectile density being sufficient to achieve the high flight speeds desired, unless the particles are themselves of an undesirably dense and hard material.

A further, particulate filled, non-rolling, ball is described in U.S. Pat. No. 3,924,856 but also has an undesirable, rigid finger-clip.

SUMMARY OF THE INVENTION

An object of the invention is to provide an amusing court game which can be played by people of all ages and abilities and a projectile that can be launched at high speed, sustained in flight, but caught with minimal impact.

According to one aspect, the invention provides a court game set for at least two opponents comprising:

means for defining an outer court and an inner court located centrally within the outer court and a mid-line dividing the courts laterally into two equal sides providing respective playing areas for respective opponents;

net means comprising an inner net portion at least as long as the maximum width of the inner court and having upper and lower horizontally extending edges and at least marking lines extending from respective opposite ends of upper edges and being of lengths at least equal to the widths of portions of the outer court remaining outside the inner court;

means for supporting the net means above the mid-line with the inner net portion and outer net portions aligned with the inner court and with the remaining portions of the outer court, respectively, and with the inner net portion spanning a vertical area extending between overarm throwing heights of standing and jumping opponents and the marking lines extending level with the upper edge thereof;

a catchable projectile comprising:

a collapsed elongate tube of flexible material having a leading blind end and a trailing end formed with a grasping portion;

a round, resiliently compressible, impact absorbing, compact, integral, body mass received in the blind end;

whereby the projectile can be swung and launched at great speed by an opponent holding the grasping portion and caught with minimal impact as a result of the impact absorption of the body mass and a projectile launched by an opponent from one side of the net passing above the net and hitting the ground on the other side of the net within the outer court or passing below the net and hitting the ground of only the inner court will score.

The game set has few parts which may be economically manufactured for supply at low cost, easily transported to a public playing area, such as a beach, provide scope for players of all ages with very high and very modest degrees of skill, the projectile enabling launch at very high speed but, as a result of the impact absorbing deformation, obviating risk of hurt even to very small children to which the almost serpentine shape is inherently attractive.

The court may, for example, be marked out on a sandy beach with each side of the inner court, suitably, square and each side of the outer court, rectangular, of width, triple the width of the inner court and of length, quadruple the width of the inner court.

To ensure that the projectile must normally rise in flight, (except when used by the most skilled players), to score a point when landing anywhere within the outer court, the net spans a vertical distance of about three feet with the lower edge spaced about eight feet above the ground and the upper edge about eleven feet above the ground.

To assist in impact absorption, in particular, the projectile body may be of teardrop shape, while the tube may be resiliently deformable in a lateral direction for expansion to accommodate deformation of the projectile body on impact. An increase in theoretical launch speed may be obtained by resilient extension of the tube, as a result of centrifugal forces, on swinging or twirling.

In one practical structure, the projectile body is secured adjacent the blind end by transverse stitching through the tube while the trailing end portion is bent back on itself to double thickness, providing a relatively less extensible, finger-engageable portion.

A most advantageous material for the projectile body is a gel, such as soybean oil gel, or an elastomeric bladder filled with gel or a liquid, both having the inherent property of equal force distribution in all directions enhancing impact absorbing characterics.

The invention includes the projectile per se.

BRIEF DESCRIPTION OF THE DRAWINGS

A specific embodiment of the game and projectile according to the invention will now be described with reference to the accompanying drawings in which:

FIG. 2(*b*) is a schematic perspective view of the projectile in normal, rest condition;

FIG. 2(*c*) is a schematic view of the projectile being twirled; and,

FIG. 2(*d*) is a schematic view of the projectile on impact.

DESCRIPTION OF PREFERRED EMBODIMENT

The game comprises a playing court 11 for at least two, preferably four or more, players and a projectile 20 constructed to be manually launched with great velocity and to be caught with minimal impact.

Figure 1:
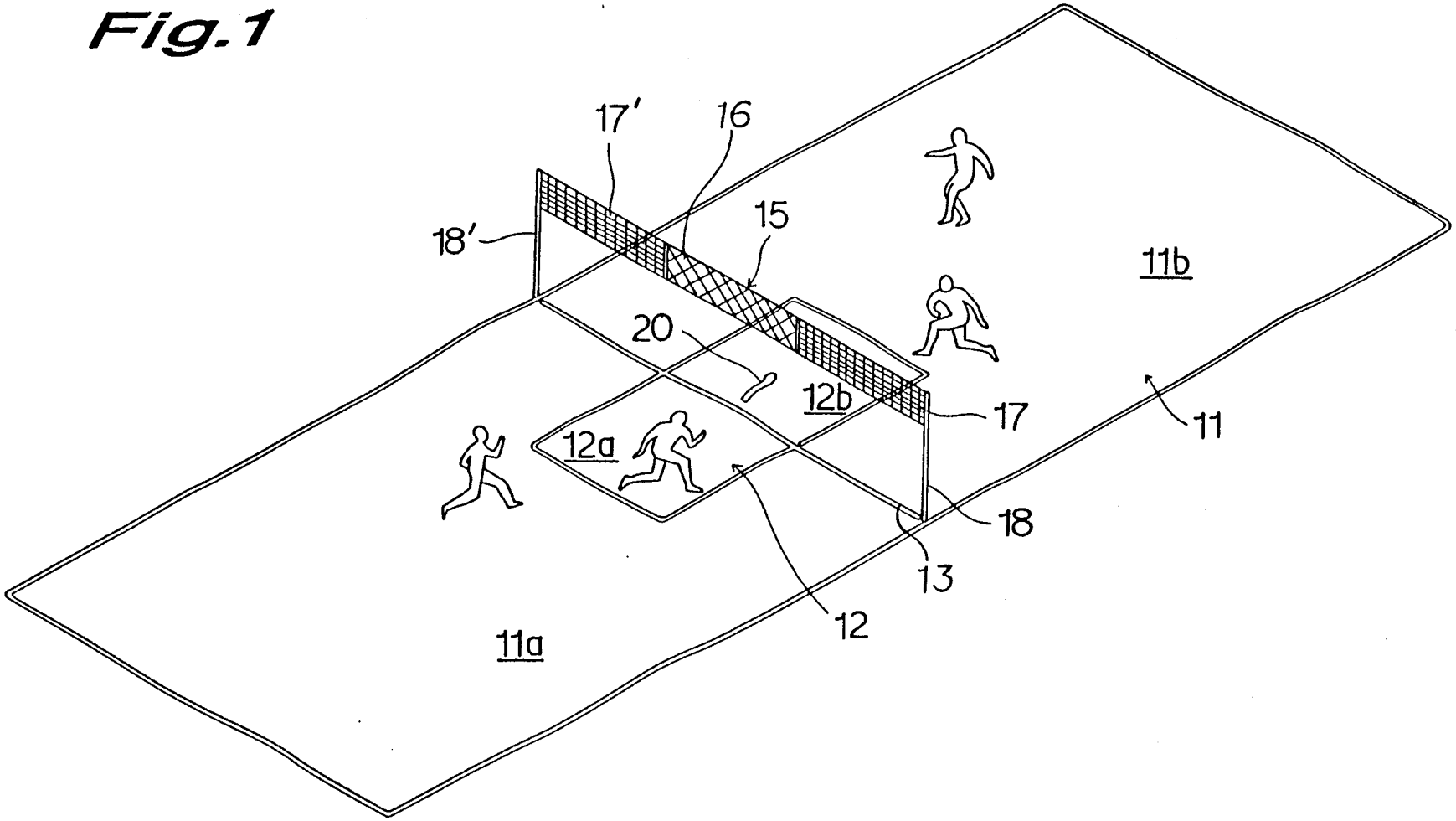
FIG. 1 is a schematic perspective view of the court.

As shown in FIG. 1, a game set includes marking lines drawn in the sand to delineate an outer court 11 and an inner court 12 located centrally within the outer court and a mid-line 13 dividing the courts laterally into two equal sides 11(*a*) and 11(*b*), and 12(*a*) and 12(*b*), respectively, providing respective playing areas for respective opponents. Each side 11(*a*) and 11(*b*) of the inner court is square and each side 12(*a*) and 12(*b*) of the outer court is rectangular having a width triple that of the inner court and a length quadruple the width of the inner court.

The optimum net length and dimensions of the inner and outer courts depend on the speed of the playing surface which may be sand, grass, asphalt, etc.

An elongate net 15 having an inner portion 16 of the same length as the width of the inner court 11 and portions 17, 17' of different color and mesh extending from respective opposite ends of the inner portion 16 and each being of the same length as the width of the portion of the outer court remaining outside the inner court. The net is approximately three feet in height, and poles 18, 18' support respective opposite ends thereof with upper and lower longitudinal edges spaced eleven feet and eight feet from the ground, respectively, so that the net spans average, adult overarm throwing height between standing and jumping positions. Clearly, optimal net height varies according to the height of the players as do other court dimensions.

Figure 2C:
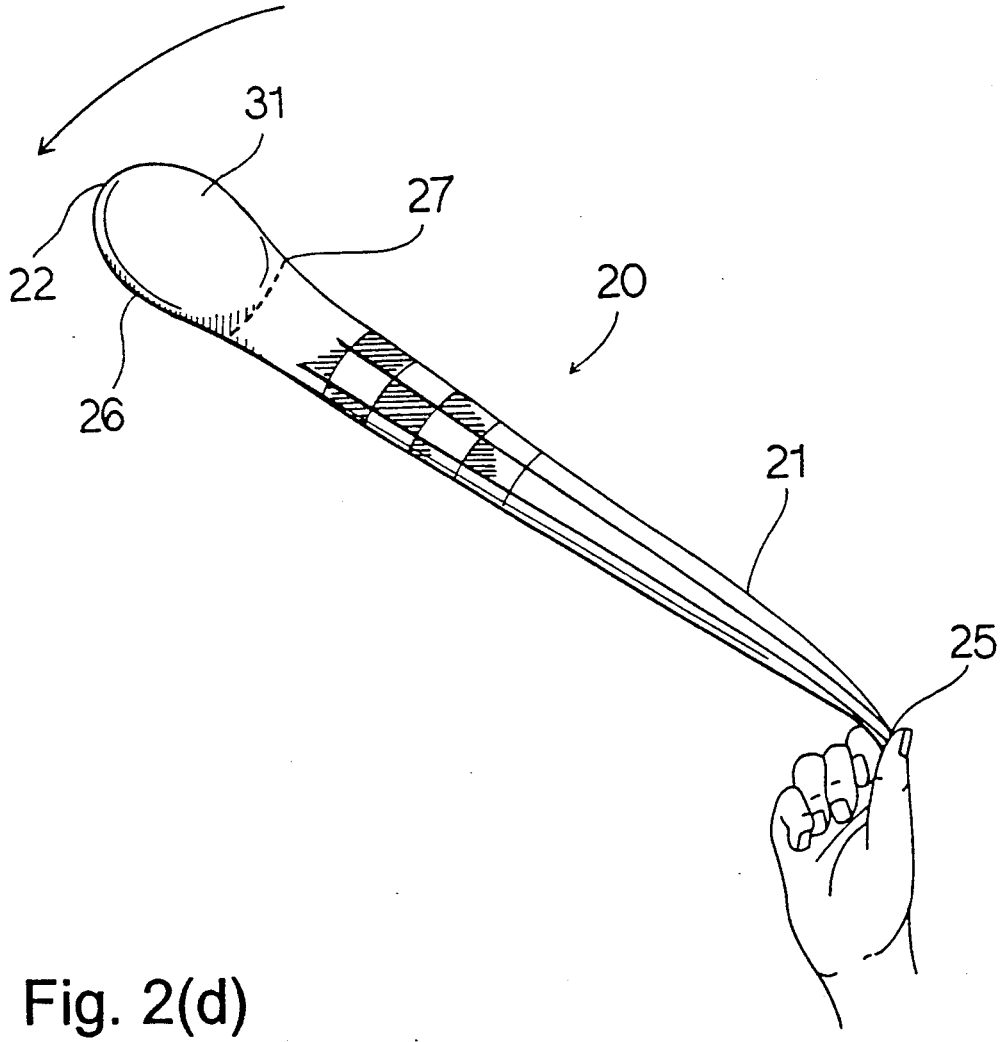
FIG. 2(*a*) is a schematic plan view of the projectile with the tube thereof as shown in flat condition, for clarity.
Figure 2D:
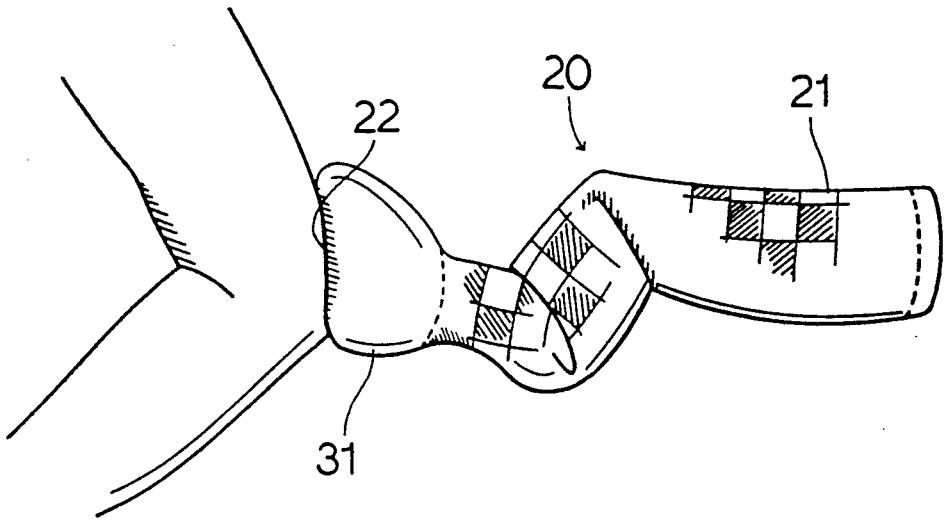

As shown in FIG. 2(*a*) and FIG. 2(*b*), a projectile 20 constructed for hand launch at great speed and for minimal impact effect, comprises a normally collapsed tube or sleeve 21 of resiliently flexible fabric having a leading blind end 22 and an open, trailing end 23, edge portions 24 of which are turned back and sewn together to double thickness providing a finger-grip or grasping portion 25. The fabric is brightly colored in check, stripe or other pattern combination. Thus, the tube is resiliently stretchable longitudinally and resiliently expansible laterally. A trailing end of the tube may be split longitudinally to form individual streamers.

A generally ovate teardrop shaped, impact absorbing, dense and compact mass 31 of soybean oil gel or other suitable material, possibly a silicon gel or encapsulated liquid, is trapped in a pocket 26 formed in the blind end of the sleeve by a seam 27 sewn transversely across the tube thereby locating the mass with the larger end 32 thereof against the blind end of the tube and the tapering end thereof extending rearwardly so that the major axis of the mass 31 extends along the tube axis.

As shown in FIG. 2(*c*), the projectile may be grasped at the trailing end of the sleeve and swung or twirled for launching at great speed, the centrifugal force imposed on the sleeve by the mass producing elastic elongation thereof, further increasing the maximum potential linear velocity of launch.

As shown schematically in FIG. 2(*d*), on impact, the mass resiliently collapses, such deformation also being accommodated by lateral expansion of the tube assisting in absorbing the impact and reducing risk of injury to a player, or bystander, hit inadvertently. Non-axial impact may result in a lateral shift in the center of mass with deflection of impact force away from the point of impact enhancing impact absorption.

The tail or trailing end, stabilizes the flight, compact body mass leading, and prevents excessive roll of the projectile on impact with the ground.

As explained on an accompanying rule sheet, the object of the game is for an opponent to throw the projectile KOMETT (trademark) above or below the net to make it land in court on the other side without being caught by an opponent. If thrown below the net, the projectile must land in the inner court of the other side to score a point and, if thrown above the net, within the outer court, (including the inner court).

The first opponent to achieve both an aggregate score of at least seven points and a two point margin over the opponents aggregate score wins the match.

The game consists of three matches, the winner of at least two matches wins the game.

Clearly, the invention provides an amusing and essentially harmless projectile for toss, catch and other simple exercise useful for physical therapy which is also a relatively simple construction affording economic high volume manufacture for the mass market place.

I claim:

1. A court game set for at least two opponents comprising:

means for defining an outer court and an inner court located centrally within the outer court and a mid-line dividing the courts laterally into two equal sides providing respective playing areas for respective opponents;

net means comprising an inner net portion at least as long as the maximum width of the inner court and having upper and lower horizontally extending edges and at least marking lines extending from respective opposite ends of upper edges and being of lengths at least equal to the widths of portions of the outer court remaining outside the inner court;

means for supporting the net means above the mid-line with the inner net portion and outer net portions aligned with the inner court and with the remaining portions of the outer court, respectively, and with the inner net portion spanning a vertical area extending between overarm throwing heights of standing and jumping opponents and the marking lines extending level with the upper edge thereof;

a catchable projectile comprising:

a collapsed elongate tube of flexible material having a leading blind end and a trailing end formed with a grasping portion;

a round, resiliently compressible, impact absorbing, compact integral body mass received in the blind end;

whereby the projectile can be swung and launched at great speed by an opponent holding the grasping portion and caught with minimal impact as a result of the impact absorption of the body mass and a projectile launched by an opponent from one side of the net passing above the net and hitting the ground on the other side of the net within the outer court or passing below the net and hitting the ground of only the inner court will score.

2. A court game set according to claim 1 in which each side of the inner court is square and each side of the outer court is rectangular having a width triple the width of the inner court and a length quadruple the length of the inner court.

3. A court game set according to claim 2 in which the lower and upper edges of the inner net portion are spaced eight feet and eleven feet above the ground, respectively.

4. A court game set according to claim 1 in which the projectile body is generally ovate and secured in the sleeve with the major axis extending along the tube axis.

5. A court game set according to claim 4 in which the projectile body is of teardrop shape having the tapering end remote from the blind end of the tube.

6. A court game set according to claim 1 in which the tube is resiliently stretchable longitudinally.

7. A court game set according to claim 6 in which the tube is resiliently expansible laterally.

8. A court game set according to claim 1 in which the projectile body is secured adjacent the blind end of the tube by stitching passing transversely through the tube.

9. A court game set according to claim 1 in which the tube has an open trailing end secured, turned back on itself, to double thickness, hem fashion, providing a finger gripping portion.

10. A court game set according to claim 1 in which the projectile body is made of a gel.

11. A court game set according to claim 1 in which the projectile body is made of a gel filled bladder.

12. A court game set according to claim 1 in which the projectile body is made of a liquid filled bladder.

13. A catchable projectile comprising a collapsed fabric tube resiliently flexible in both longitudinal and lateral directions, having a blind leading end and a grasping portion at a trailing end, the blind end containing only a single round, resiliently compressible, compact, impact absorbing, unitary body mass formed entirely by a resilient bladder filled with one of a gel and liquid in intimate, direct contact with the fabric of the blind end of the tube so that swinging the tube by the grasping portion resiliently extends the length thereof as a result of centrifugal effects thereby to increase the linear speed of launch and, on impact of the body, the tube resiliently extends in width to accommodate the resilient impact absorbing deformation of the body.

14. A catchable projectile according to claim 13 in which the tube is formed with a mouth at the trailing end with an edge portion secured folded back on itself to double thickness providing a relatively inextensible finger grip at the end of the grasping portion.

15. A catchable projectile according to claim 13 in which the body mass is made of soybean oil gel.

16. A catchable projectile according to claim 13 in which the body mass is of generally teardrop shape having a tapering end extending towards the trailing end.

17. A catchable projectile according to claim 13 in which stitching extending transversely through the tube adjacent and spaced from the blind end defines a body trapping pocket receiving the body mass.

18. A catchable projectile according to claim 13 in which the trailing end of the tube is longitudinally split to form individual streamers.

19. A catchable projectile comprising a collapsed fabric tube resiliently flexible in both longitudinal and lateral directions, having a blind leading end and a grasping portion at a trailing end, the blind end containing only a single round, resiliently compressible, compact, impact absorbing, unitary body mass formed entirely by a gel in intimate direct contact with the fabric of the blind end of the tube so that swinging the tube by the grasping portion resiliently extends the length thereof as a result of centrifugal effects, thereby to increase the linear speed of launch and, on impact of the body, the tube resiliently extends in width to accommodate the resilient impact absorbing deformation of the body.

20. A catchable projectile according to claim 19 in which the body mass is of generally teardrop shape having a tapering end extending towards the trailing end.

21. A catchable projectile according to claim 20 in which stitching extends transversely through the tube adjacent and spaced from the blind end defines a body trapping pocket receiving the body mass.

* * * * *